US005794704A

United States Patent [19]

Brennecke et al.

[11] Patent Number: 5,794,704

[45] Date of Patent: Aug. 18, 1998

[54] FIRE EXTINGUISHING DEVICE FOR AN ELECTROSTATIC COATING FACILITY

[75] Inventors: Hermann Brennecke, Darmstadt; Horst Liere, Eppertshausen, both of Germany

[73] Assignee: IRS Industrie Rationalisierungs-Systeme GmbH, Griesheim, Germany

[21] Appl. No.: 643,441

[22] Filed: May 8, 1996

[30] Foreign Application Priority Data

May 12, 1995 [DE] Germany ..... 195 17 494.1

[51] Int. Cl.[6] ..... A62C 3/00

[52] U.S. Cl. ..... 169/54; 169/70; 239/691; 239/695; 118/629

[58] Field of Search ..... 169/54, 61, 13, 169/70; 239/691, 695; 118/629

[56] References Cited

U.S. PATENT DOCUMENTS

| | | | |
|---|---|---|---|
| 630,860 | 8/1899 | Clark et al. | 169/13 |
| 3,884,304 | 5/1975 | Messerschmidt et al. | 169/16 |
| 4,305,469 | 12/1981 | Morrisette | 169/16 |
| 4,356,868 | 11/1982 | Bentley et al. | 169/54 |
| 4,688,644 | 8/1987 | Hemming | 169/61 |
| 5,113,944 | 5/1992 | Nakagawa et al. | 169/13 |

FOREIGN PATENT DOCUMENTS

| | | | |
|---|---|---|---|
| 349475 | 1/1990 | European Pat. Off. | 169/54 |
| 38 21 851 C2 | 4/1992 | Germany . | |
| 41 12 308 A1 | 10/1992 | Germany . | |

*Primary Examiner*—Gary C. Hoge
*Attorney, Agent, or Firm*—Panitch Schwarze Jacobs & Nadel, P.C.

[57] ABSTRACT

A device for extinguishing a fire in an electrostatic coating facility has at least one coating nozzle associated with high voltage, the nozzle being connectable with an extinguishing agent reservoir via a conduit. With previously known extinguishing agents, the problem emerges in connection with the aforementioned coating facilities, that a longer lasting cleaning process follows even after only a short extinguishing process. In order to avoid this problem, desalinated water is used as the extinguishing agent in the extinguishing agent reservoir.

10 Claims, 2 Drawing Sheets

FIRE EXTINGUISHING DEVICE FOR AN ELECTROSTATIC COATING FACILITY

FIELD OF THE INVENTION

The invention concerns a device for extinguishing a fire in an electrostatic coating facility, the device having at least one nozzle connectable with extinguishing agents via a conduit.

BACKGROUND OF THE INVENTION

In powder coating installations and in painting installations, one works with so-called electrostatic painting processes in order to obtain an even coating of the workpiece to be coated with powder or paint. That is, certain parts of the coating installation stand under high tension (voltage). Due to this high tension, discharge events occur in some cases with sparking, and this sparking can easily lead to a fire in the sprayed coating agents. In order to extinguish such a fire, it is known to interrupt the supply of coating agents to the coating nozzle and to conduct an extinguishing agent, for example powder, foam or an inert gas, for a period of about ½ seconds via a nozzle to the seat of the fire and thereby extinguish the fire.

The extinguishing agents mentioned have, however, the disadvantage that they either make necessary an intensive cleansing of the coating facility before continuing the coating process (in the case of extinguishing powder or foam), or that they are nonetheless very expensive (in the case of inert gases).

SUMMARY OF THE INVENTION

From these aspects, the object emerges for the present invention to find an extinguishing agent which avoids these disadvantages, that is, which can be used in an uncomplicated manner, and is at the same time moderately priced. This object is achieved in accordance with the present invention by providing desalinated water in the extinguishing agent reservoir as the extinguishing agent. As used herein, the term "water" is intended to mean water in liquid form.

Water is indeed basically known as a fire extinguishing agent, but with normal water, as with powder or foam, all components of the electrostatic coating facility which were sprinkled with quenching water must be dried clean following each extinguishing event, especially in view of the fact that, owing to its mineral content, normal water conducts electricity, and consequently hinders the build up of high electrostatic voltage. Drying thereby requires a great deal of time, and the outage times for the coating facility are correspondingly long.

Since, however, the desalinated water used as the extinguishing agent of the invention does not conduct electricity, these specific disadvantages do not arise. This extinguishing agent is in this regard also cheaper than special inert gases and can, especially in contrast with gases which can only be transported in cylinders under pressure, also be transported without any kind of danger.

According to a preferred embodiment, the extinguishing agent nozzle is integrated into the coating nozzle. Since the fire most frequently occurs directly at the coating nozzle, an especially rapid and effective extinguishing is consequently attainable.

With the use of demineralized water as an extinguishing agent in accordance with the invention, only one conduit need actually be applied directly to the coating nozzle, through which either coating material or extinguishing agents are conducted to the coating nozzle. Switching between these two substances takes place by means of a control valve installed in the conduit at a distance from this nozzle. One thus saves a separate conduit for the extinguishing agent, since the demineralized water has no interaction with the coating material, especially with the so-called water based paints used ever more frequently today, in which water is used as a solvent.

A solenoid valve is one possible choice for the aforementioned control valve, which makes possible a particularly rapid switching back and forth.

In order for the extinguishing with demineralized water to take place as rapidly as possible, the device can have a pressure step-up pump, which increases the pressure of the desalinated water used as an extinguishing agent. It is thus assured that this desalinated water reaches the point to be extinguished in sufficient quantity.

On the one hand, the pressure step-up pump can indeed be installed between the extinguishing agent reservoir and the coating nozzle. It is, however, advantageous if the pressure step-up pump is placed before the extinguishing agent reservoir and then pumps the quenching water into the extinguishing agent reservoir, whereby a compressed air cushion is then formed above the desalinated water through which the pressure increase takes place. This has the advantage that the pressure step-up pump need not be permanently in operation. Rather, in the event of an extinguishing event, the first quenching water is forced out of the extinguishing agent reservoir under increased pressure by the compressed air cushion, before the pressure step-up pump switches on and then supplies additional quenching water under high pressure.

In a coating facility in which several coating nozzles are present, these can be connected to separate conduits into which respective control valves are installed, whereby these control valves can also be activated individually by means of a control center, so that the coating nozzles can be selectively connected to the extinguishing agent reservoir.

It is generally advantageous in this regard if all parts of the facility coming into contact with the desalinated water are made of a non-corroding material, such as stainless steel or plastic. A high degree of operating reliability over the long term is thereby guaranteed.

In a preferred embodiment, the coating facility is combined with a cleaning station for workpieces to be coated. The cleaning station operates with desalinated water, and the extinguishing reservoir is connected with a circuit for desalinated water, which is available in this cleaning station. This preferred embodiment is especially advantageous because the workpieces to be coated are frequently pre-treated, for example with leaching solutions, etc., and the residues from this pretreatment still remaining on the workpieces are washed off prior to the actual coating or painting process, for which washing desalinated water is used at the present time. The demineralized or desalinated water to be used in the coating facility as an extinguishing agent connected at the outlet side is therefore in principle already present and can be diverted for extinguishing purposes without great difficulties.

It should still be mentioned that to the extent that demineralized or desalinated water is to be mentioned in this application, water is to be understood which for this particular property has such a high electrical resistance value that conductive bridges cannot arise in the coating facility, through which creeping currents can flow. This condition can also be met with water which still has a slight residue content of minerals or salts.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENT

Figure 1:
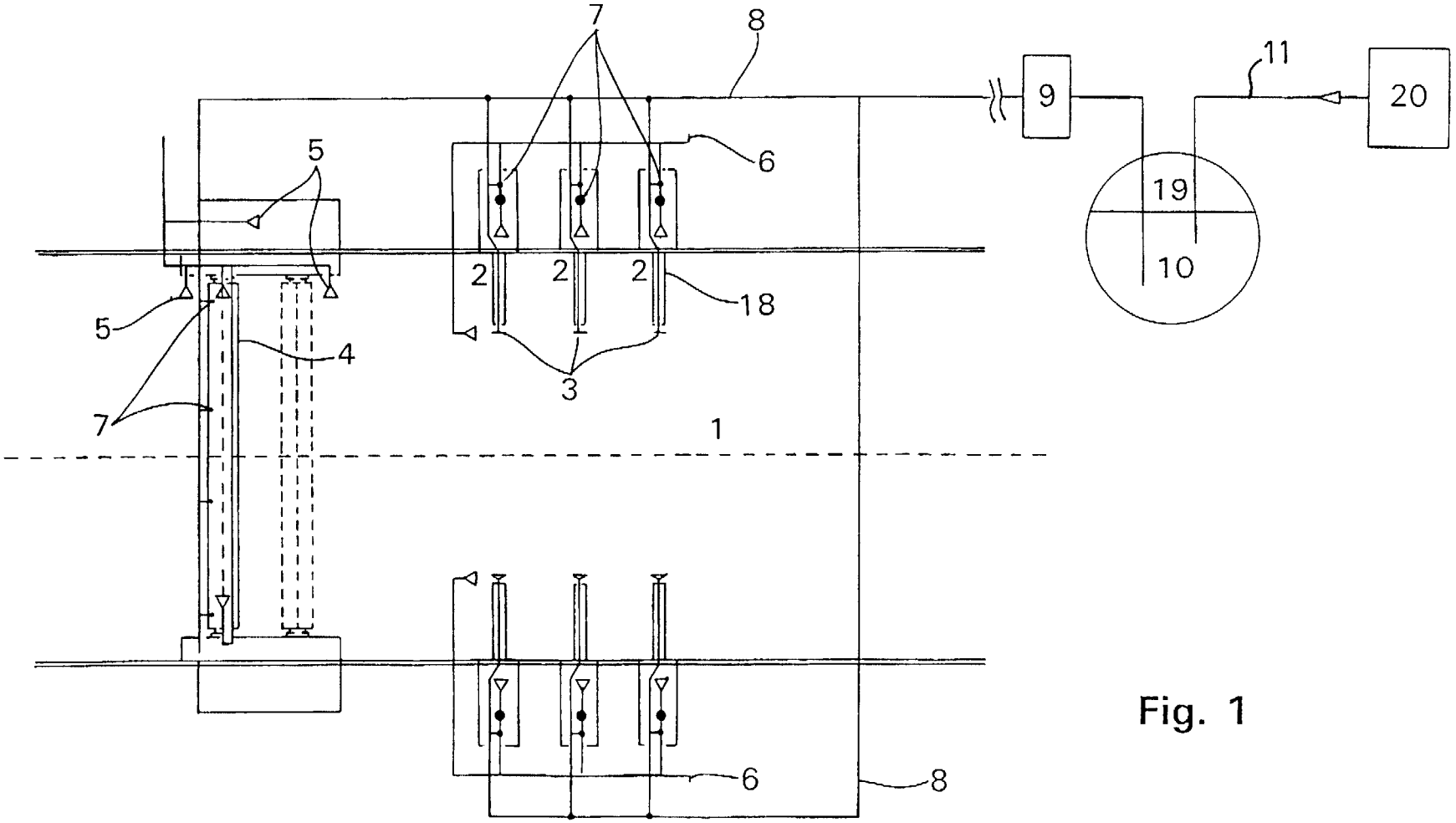
FIG. 1 is a schematic view of a chamber with an electrostatic coating facility and an extinguishing device according to the invention.

FIG. 1 depicts a chamber 1 as is frequently used in the automobile industry in order to coat automobile bodies. Electrostatic paint spraying guns 2 are mounted on the walls of this chamber 1 and carry coating nozzles 3 on their front ends, through which paint is sprayed as the coating agent on the auto body travelling by. Paint spraying guns of basically the same type, but which spray paint in a downward direction, are mounted in a ceiling machine at the exit of chamber 1.

The coating nozzles are associated with an electrostatic high voltage. This high tension can now and then discharge through flying sparks, whereby the danger arises that the spray mist in front of the paint spraying guns catches fire on account of these flying sparks. Such a fire or a corresponding flying spark can be detected with infrared detectors 5. These transmit their signals via lines 6 to a control center (not shown) which controls the appropriate control valves 7. The supply of coating agent, i.e., paint or powder, to the coating nozzles 3 is interrupted. Instead, extinguishing agent is sprayed in for about ½ second, so that the fire goes out.

With the previously known extinguishing devices, a powder, a foam or an inert gas was especially used as an extinguishing agent. Especially in connection with powder or foam, the conduit 18 arranged after the control value 7 must, however, be cleaned, for example by means of compressed air or the like, before coating agent can reenter this conduit 18. This is intricate, complicated and time-consuming, and on this account the control valves 7 depicted in FIG. 1 clear the extinguishing agent conduits 8 in which demineralized water flows as an extinguishing agent.

This demineralized water is brought to a high pressure through pressure step-up pump 9, so that it emerges in sudden bursts when the control valves 7 are opened and flows through the conduit 18 and can rapidly extinguish a fire detected at the coating nozzle 3. When the fire has been extinguished, the control valves are switched back, and the coating process interrupted at the beginning of the fire is continued, without having to eliminate residues of the demineralized quenching water.

The pressure step-up pump 9 draws the demineralized water from an extinguishing agent reservoir 10, to which the demineralized water is conducted via a conduit 11. This conduit 11 is connected with a cleaning station 20 in which the parts which are coated in chamber 1 are cleaned or washed beforehand. Desalinated or demineralized water constantly available at this cleaning station 20 is drawn from there via the conduit 11.

It is also possible to install the pressure step-up pump 9 in the conduit 11. Then a compressed air cushion 19 could form in the extinguishing agent reservoir above the desalinated water functioning as an extinguishing agent. This keeps the extinguishing agent permanently under pressure so that it flows immediately upon opening the control valves 7, and the pressure step-up pump has time to begin running.

Figure 2:
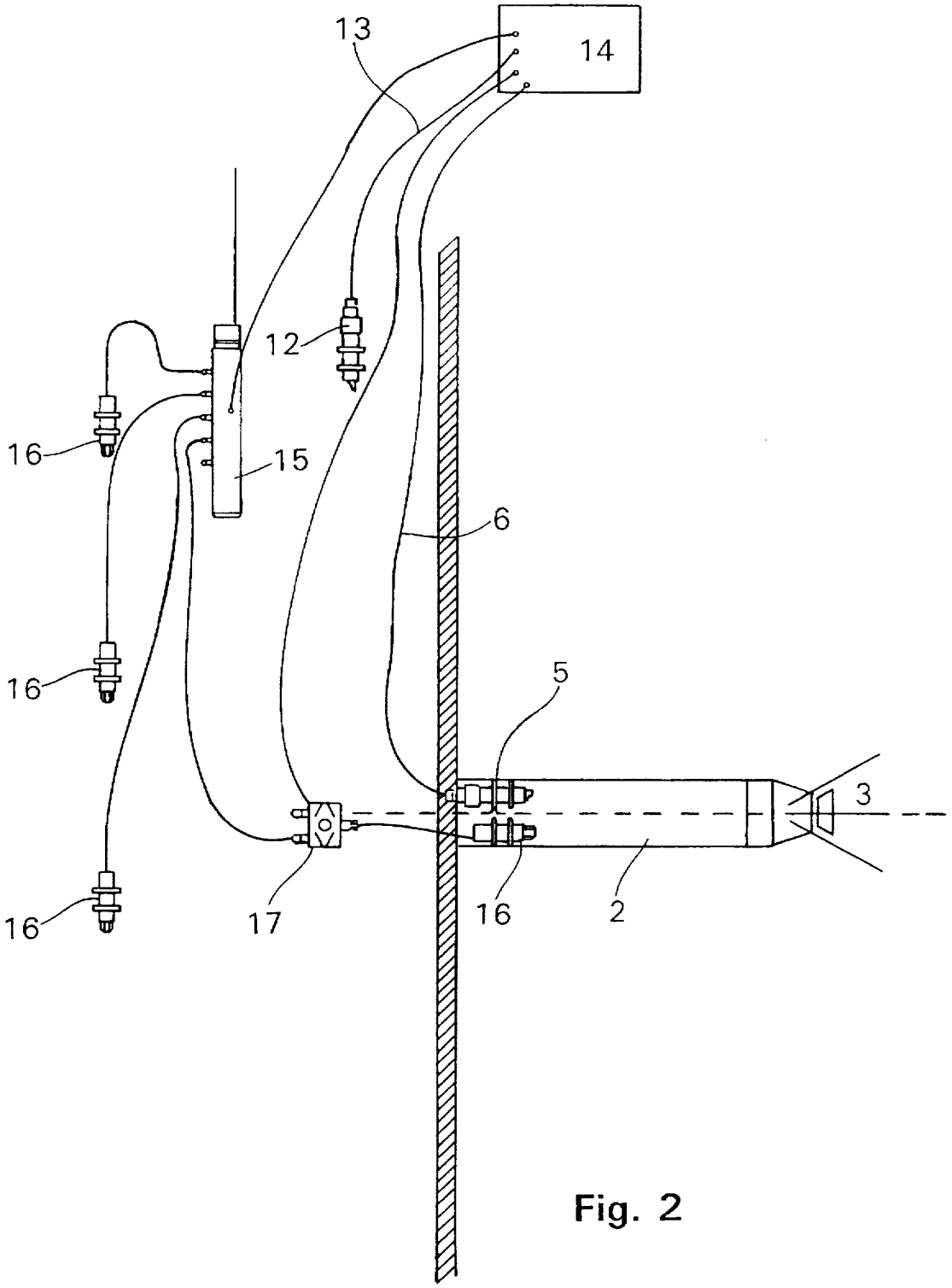
FIG. 2 is a diagrammatic sketch for the circuit of an extinguishing device according to the invention in connection with a coating facility having several coating nozzles.

The circuit arrangement of several parallel extinguishing devices is once again depicted schematically in FIG. 2. One recognizes the paint spraying guns 2 which have an electrostatic coating nozzle 3 on their front end, whereby this is equipped with a rotary atomizer with air support.

Should a fire arise on account of flying sparks, this is detected by an infrared detector 5, and its signal is forwarded via a wire 6 to a center 14.

In FIG. 2, a further IR detector 12 is depicted which is connected to the same center 14 via a line 13. This IR detector 12 can be mounted at any place where a fire can occur, for example on a further coating nozzle. Correspondingly, further IR detectors can be connected to center 14.

A quenching water distributor 15 is then controlled by means of center 14, through which quenching water is conducted to quenching water spraying nozzles 16. These quenching water spraying nozzles 16 can be installed at any desired spot, just like the IR detectors 12, for example even on further coating nozzles. Individual quenching water spraying nozzles 16 are thus provided with quenching water via the quenching water distributor 15, which is controlled by the center 14, so that a corresponding extinguishing process is only undertaken totally aimed at the actual seat of the fire.

An OR valve 17 is inserted in the conduit between quenching water valve 15 and quenching water spraying nozzle 16 in connection with integrating the quenching water spraying nozzle 16 into the coating nozzle 3. This valve admits coating agent to the spraying nozzle 16 with compressed air under normal operation and from there to the coating nozzle 3. In the event that an infrared detector 5 detects a fire, it switches from coating agents to quenching water so that the fire is immediately extinguished.

For this switching, valve 17 a rapidly switching solenoid valve is used which is controlled from the center 14. Thus, after a fire is reported in the center 14 by an IR detector, the center 14 actuates the quenching water distributor 15 and the valve 17, so that for about ½ second demineralized quenching water flows to the fire and extinguishes it. Then the valve 17 is switched back again and the coating process, which was interrupted when the fire began, is continued without a long drying and cleaning of parts which came into contact with the quenching water.

All previously described parts which come into contact with quenching water, such as the quenching water reservoir, conduits 8 and 11, quenching water distributor 15, quenching water spraying nozzles 16, and the valve 17, consist of non-corroding material, i.e., that is, either of plastic or stainless steel.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A device for extinguishing a fire in an electrostatic coating facility comprising at least one spraying nozzle (3) located in an electrostatic coating facility, said nozzle being connectable with an extinguishing agent reservoir (1) via a conduit (8), said extinguishing agent reservoir (10) containing desalinated water as the extinguishing agent.

2. The device according to claim 1, wherein the at least one spraying nozzle is a coating nozzle located in a high voltage area of the electrostatic coating facility.

3. The device according to claim 2, further comprising a control valve (7, 17) located before the coating nozzle (3) in a conduit (18), the conduit (18) serving to convey either coating material or extinguishing agent to the coating nozzle (3).

4. The device according to claim 3, wherein the control valve (7, 17) is a solenoid valve.

5. The device according to claim 1, further comprising a pressure step-up pump (9) for raising the pressure of the desalinated water.

6. The device according to claim 5, wherein the pressure step-up pump (9) is arranged between the extinguishing agent reservoir (10) and the nozzle (3).

7. The device according to claim 5, wherein the pressure step-up pump (9) serves for creating a compressed air cushion (19) in the extinguishing agent reservoir above the desalinated water.

8. The device according to claim 1, wherein several nozzles (3) are present in separate conduits (18), and control valves (7, 17) are present in the conduits which can be activated individually through a control center (14) so that the nozzles (3) can be connected selectively with the extinguishing agent reservoir (10).

9. The device according to claim 1, wherein all parts of the device coming into contact with the desalinated water are made of non-corroding material.

10. The device according to claim 1, further comprising a cleaning station for workpieces to be coated, the cleaning station operating with desalinated water, and the extinguishing agent reservoir (11) being connected with a circuit for desalinated cleaning water.

* * * * *